US006336695B1

(12) United States Patent
Ha

(10) Patent No.: US 6,336,695 B1
(45) Date of Patent: Jan. 8, 2002

(54) MOTOR DRIVING DEVICE AND METHOD

(75) Inventor: Jong-Ho Ha, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/185,739

(22) Filed: Nov. 4, 1998

(30) Foreign Application Priority Data

Nov. 4, 1997 (KR) ..... 97-57861

(51) Int. Cl.[7] ..... B41J 2/195; B41J 23/00; B41J 19/00; B41J 25/34

(52) U.S. Cl. ..... 347/7; 347/37; 400/283

(58) Field of Search ..... 347/7, 37; 400/283

(56) References Cited

U.S. PATENT DOCUMENTS 5,997,121 A * 12/1999 Altfather et al. ..... 347/7
6,151,039 A * 11/2000 Hmelar et al. ..... 347/7

* cited by examiner

*Primary Examiner*—John Barlow
*Assistant Examiner*—Alfred Dudding
(74) *Attorney, Agent, or Firm*—Robert E. Bushnell, Esq.

(57) ABSTRACT

A motor driving device for changing the current of the driving control signal of the carrier motor according to the consumption quantity of the ink in the inkjet printer includes a detector of an ink consumption quantity for outputting a comparative signal when a present ink quantity stored within the ink cartridge is less than the reference ink quantity, through counting each ink drop signal produced by at least one ink drop formed in each of a number of nozzles of the inkjet printer, to provide a count signal for comparison with a reference signal indicating the reference ink quantity, a voltage generator for outputting a motor driving control voltage having a variable voltage according to whether the comparative signal is produced by the detector, and a motor controller for outputting a plurality of phase control signals each having associated therewith a different driving current for driving the carrier motor according to the motor driving control voltage and according to at least one of first and second phase signals for the driving current for the carrier motor.

18 Claims, 2 Drawing Sheets

MOTOR DRIVING DEVICE AND METHOD

CLAIM OF PRIORITY

Figure 1:
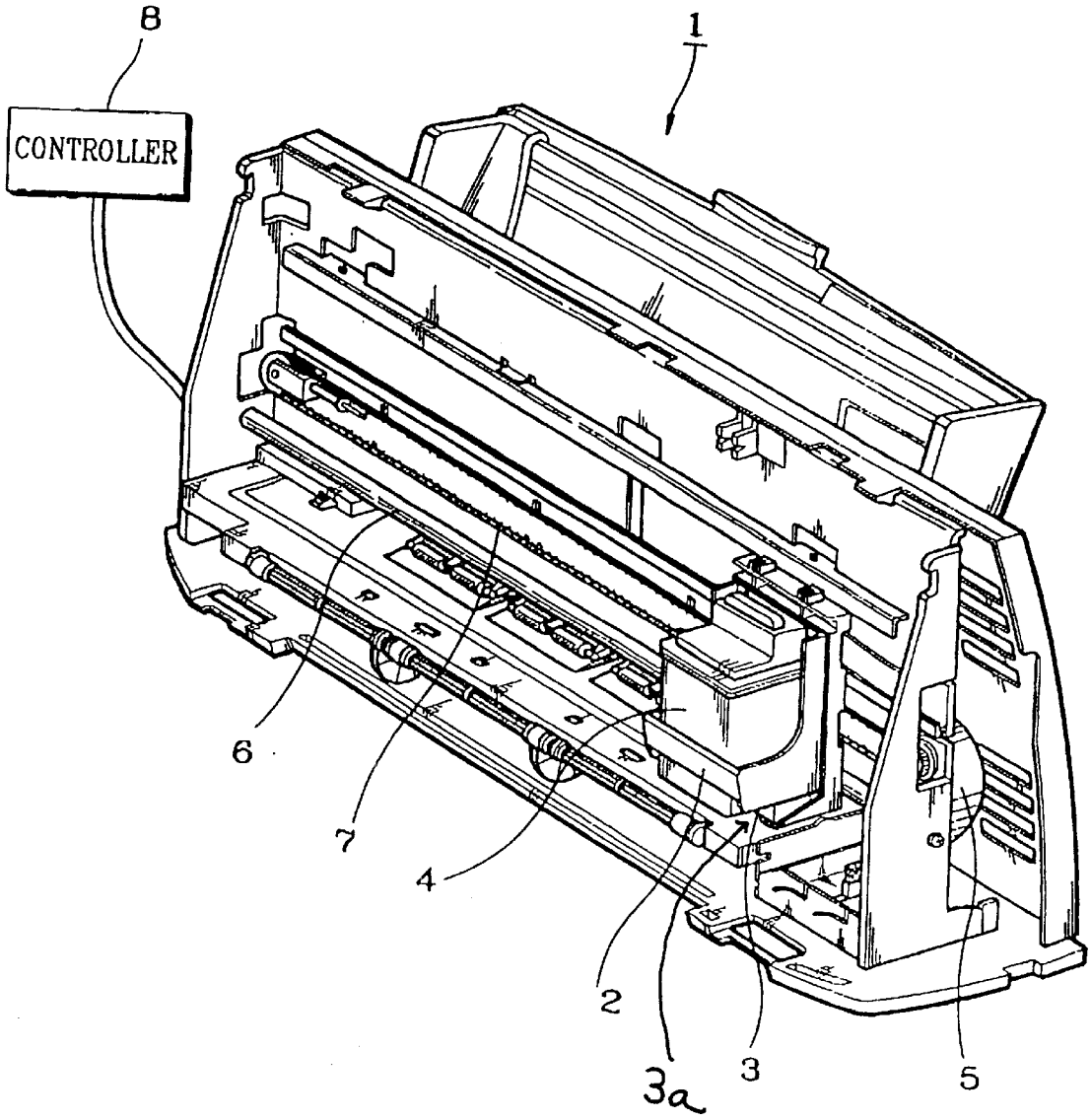

This application makes reference to, incorporates the same herein, and claims all benefits accruing under 35 U.S.C. §119 from my application entitled MOTOR DRIVER CIRCUIT filed with the Korean Industrial Property Office on Nov. 4, 1997 and there duly assigned Serial No. P97-57861 by that Office.

BACKGROUND OF THE INVENTION

1. Field of the Invention

The present invention relates to a motor driving device, more particularly to a motor driving device for making a current of a driving control signal of a carrier motor variable according to an ink consumption quantity in an inkjet printer.

2. Discussion of Related Art

A motor driving device exemplary of contemporary practice in the art for driving a carrier motor of an inkjet printer drives the carrier motor with a driving current by determining the driving current of the carrier motor on the basis of an ink quantity first stored within an ink cartridge regardless of an ink quantity stored within the ink cartridge for driving the carrier motor.

Accordingly, such a motor driving device exemplary of contemporary practice in the art can have problems relating to wasting electric power by consuming unnecessary energy for driving the motor according to the ink consumption, in that a driving current for driving the carrier motor is always constant, even though ink stored within the ink cartridge through use of the inkjet printer is consumed. Also, in that a load of the carrier being driven by the carrier motor is reduced as the ink is consumed, unnecessary noise in movement of a carrier can be caused due to unnecessary energy being consumed.

SUMMARY OF THE INVENTION

Accordingly, it is therefore an object of the present invention to provide a motor driving device capable of saving consumption of electric power and preventing unnecessary noise by making a driving current for the carrier of the inkjet printer variable according to an ink quantity stored within an ink cartridge.

In order to achieve the above and other objects of the present invention, a motor driving device according to the present invention includes: a detector of an ink consumption quantity outputting a comparative signal when a present ink quantity stored within the ink cartridge is less than the reference ink quantity through counting whether an ink drop signal is activated compared against a received reference signal indicating the reference ink quantity, the ink drop signal for producing an ink drop formed in at least one of a number of nozzles of the inkjet printer; a voltage generator for outputting a motor driving control voltage having a variable voltage according to whether the comparative signal is output from the detector, the voltage generator for receiving the comparative signal; and a motor controller for outputting a plurality of phase control signals each having associated therewith a different driving current for driving the carrier motor according to the motor driving control voltage received from the voltage generator and according to at least one of a first phase signal and a second phase signal for the driving current.

Also, the detector of an in consumption quantity preferably includes a counter for outputting a count signal to indicate a present ink quantity stored within the ink cartridge through counting each ink drop signal by receiving each ink drop signal producing a corresponding at least one ink drop, after checking whether the ink drop is formed in at least one of a number of nozzles of the inkjet printer; and a comparator for outputting a comparative signal if the count signal is smaller than the reference signal by receiving and comparing the count signal and the reference signal indicating the reference ink quantity.

Also, in the present invention the voltage generator preferably outputs a motor driving control voltage having a first voltage if the comparative signal is not output by the detector and having a second voltage smaller than the first voltage if the comparative signal is output by the detector.

Further, the voltage generator preferably includes a first resistance having one terminal connected to a first supply voltage and the other terminal for outputting a motor driving control voltage; a second resistance having one terminal for connection to the motor driving control voltage and the other terminal being connected to a second supply voltage through a switching member; a third resistance having one terminal for connection to the motor driving control voltage; and a switching member, through which the other terminal of the third resistance gets cut (or closed) or opened to the second supply voltage by the switching member becoming turned on or off according to whether the comparative signal is received by the switching member.

Moreover, the motor controller preferably outputs a plurality of phase control signals for the driving current for the carrier motor according to whether the motor driving control voltage has a first voltage for providing a larger driving current for the carrier motor than when the motor driving control voltage has a smaller second voltage than the first voltage, by receiving the motor driving control voltage and at least one of first and second phase signals for the driving current.

Further, the switching member preferably includes a transistor having an emitter, a base and a collector, in which the emitter is for connection to the second supply voltage and the base is for connection to receive the comparative signal and the collector is connected to the other terminal of the second resistance.

Also, the present invention provides a motor driving device for an ink jet printer that includes an inkjet printer head for reciprocating movement on a carrier, an ink storing vessel for reciprocating movement concurrently with the inkjet printer head and for connection with the inkjet printer head, a detecting means for sensing an amount of remaining ink in the ink storing vessel, a driving means for driving the inkjet printer head and the ink storing vessel for the reciprocating movement, and a power controller for changing the voltage supplied to the driving means according to a sensing result of the amount of the remaining ink in the ink storing vessel by the detecting means.

BRIEF DESCRIPTION OF THE ATTACHED DRAWINGS

Figure 2:
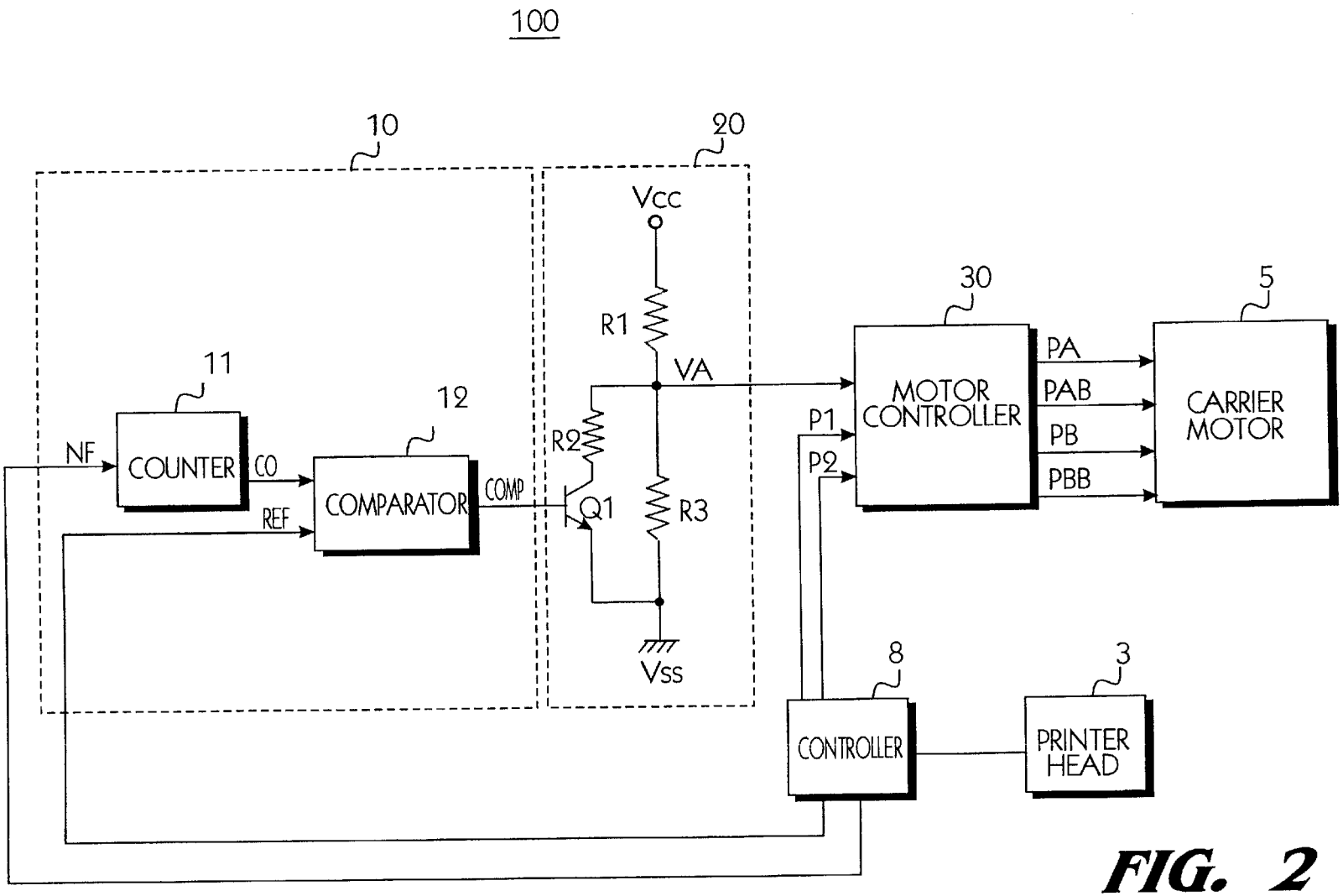

A more complete appreciation of the invention, and many of the attendant advantages thereof, will be readily apparent as the same becomes better understood by reference to the following detailed description when considered in conjunction with the accompanying rawings in which like reference symbols represent the same or similar components, wherein:

FIG. 1 is a diagrammatic illustration of an inkjet printer to which the present invention is applicable; and FIG. 2 is a block diagram view of a motor driving device according to the present invention.

DETAILED DESCRIPTION OF PREFERRED EMBODIMENTS

The motor driving device according to the present invention can be considered in detail in conjunction with the accompanying drawings as follows.

Referring to FIG. 1, FIG. 1 illustrates an inkjet printer 1 to which the motor driving device of the present invention is applicable. The inkjet printer 1 has a carrier or carriage 2 on which an inkjet printer head 3 is mounted for reciprocating movement. Also, an ink storing vessel or ink cartridge 4 for reciprocating movement concurrently with the inkjet printer head 3 is also mounted on the carrier 2 for connection with the inkjet printer head 3. A driving means, such a motor or carrier motor 5 for driving the inkjet printer head 3 and the ink storing vessel or ink cartridge 4 for reciprocating movement is associated with a shaft 6 and a belt 7 to provide the reciprocal back and forth movement of the carrier 2, thereby providing the reciprocating movement for the inkjet printer head 3 and ink cartridge 4. Controller 8 for controlling the operation of the inkjet printer 1 is illustrated and can be located inside of the inkjet printer 1 or separate from the inkjet printer 1, such as a computer system or a central processing unit (CPU).

FIG. 2 is a block view of the motor driving device 100 according to the present invention. Referring to FIGS. 1 and 2, the motor driving device 100 according to the present invention includes a detector of an ink consumption quantity 10 for outputting a comparative signal (COMP) when a present ink quantity stored within the ink cartridge 4 is less than the reference ink quantity through counting a quantity of the ink drop signal (NF) received from controller 8 indicating producing at least one ink drop in at least one of a number of nozzles 3*a* of the inkjet printer head 3 and for comparing a count signal (CO) of such counted quantity of the ink drop signal with a reference signal (REF) indicating the reference ink quantity, the signal (REF) being provided to detector 10 from controller 8. Motor driving device 100 also includes a voltage generator 20 for outputting a motor driving control voltage (VA) having a variable voltage according to whether the comparative signal (COMP) is output from detector 10. The motor driving device 100 also includes a motor controller 30 for outputting a plurality of phase control signals (PA, PAB, PB, PBB) each having a different driving current associated therewith for driving the carrier motor 5 according to the motor driving control voltage (VA) by receiving the motor driving control voltage (VA) from voltage generator 20 and according to at least one of first and second phase signals (P1, P2) from controller 8 for the driving current for carrier motor 5.

The detector of an ink consumption quantity 10 includes a counter 11 for outputting a count signal (CO) to indicate a present ink quantity stored within the ink cartridge 4 through counting each ink drop signal (NF) received from controller 8 corresponding to at least one produced ink drop, controller 8 checking whether at least one ink drop is formed in at least one of a number of nozzles 3a of printer head 3 of the inkjet printer 1. Detector 10 also includes a comparator 12 for outputting a comparative signal (COMP) to voltage generator 20 if the count signal (CO) from controller 8 is smaller than the reference signal (REF) by receiving and comparing the count signal (CO) and the reference signal (REF) indicating the reference ink quantity.

The voltage generator 20 outputs a motor driving control voltage (VA) having a first voltage if the comparative signal (COMP) is not output from comparator 12 of detector 10 and having a second voltage smaller than the first voltage if the comparative signal (COMP) is output from comparator 12 and received by voltage generator 20.

The voltage generator 20 includes a first resistance device or first resistor (R1), in which one terminal is connected to a first supply voltage (Vcc), which is larger than an earth voltage, and the other terminal of first resistor (R1) outputs a motor driving control voltage (VA). The voltage generator 20 also includes a second resistance device or second resistor (R2), in which one terminal is connected to the motor driving control voltage (VA) and the other terminal is connected to a second supply voltage (Vss) through a switching member (Q1), the second supply voltage (Vss) being an earth or local reference voltage, and includes a third resistor (R3), in which one terminal is connected to the motor driving control voltage (VA). The voltage generator 20 further includes a switching member or switching device (Q1), such as an NPN bipolar transistor, with which the other terminal of the third resistor (R3) gets cut (or closed) or opened to the second supply voltage (Vss) by the switching member (Q1) becoming turned on or off according to whether the comparative signal (COMP) is activated and output from comparator 12.

The motor controller 30 outputs a plural of phase control signals (PA, PAB, PB, PBB) for the driving current for the carrier motor 5 according to whether the motor driving control voltage (VA) has the first voltage for providing a larger driving current for the carrier motor 5 than when the motor driving control voltage (VA) has the smaller second voltage than the first voltage to provide a smaller driving current than the driving current corresponding to the first voltage and according to at least one of the first and second phase signals (P1, P2) for the driving current from controller 8.

The switching member (Q1) preferably is a transistor, such as an NPN bipolar transistor including an emitter, a base and a collector. The emitter of transistor or switching member (Q1) is connected to the second supply voltage (Vss) and the base of transistor or switching member (Q1) is connected to receive the comparative signal (COMP) from comparator 12 and the collector of transistor or switching member (Q1) is connected to the other terminal of the second resistor (R2).

The operation of the motor driving device 100 of the present invention can be described as follows, again with reference to FIGS. 1 and 2.

A counter 11 of the detector of an ink consumption quantity 10 outputs a count signal (CO) indicating a present ink quantity stored within the ink cartridge 4 through counting each ink drop signal (NF) for producing at least one ink drop formed in at least one of a number of nozzles 3*a* of the printer head 3 of inset printer 1. Comparator 12 of the detector of an ink consumption quantity 10 outputs a comparative signal (COMP) if the count signal (CO) is smaller than the reference signal (REF) by receiving and comparing the count signal (CO) from counter 11 and the reference signal (REF) from controller 8 indicating the reference ink quantity.

When the quantity of the ink now remaining within the ink cartridge 4 exceeds the reference quantity of the ink, the comparative signal (COMP) is not output by comparator 12 and the switching member (Q1) of voltage generator 20 is turned off and the second resistor (R2) gets opened, so the impedance value of the voltage generator 20 is R1+R3. Accordingly, the motor driving control voltage (VA) as an output of the voltage generator 20 has the first voltage as R3/(R1+R3) X Vcc. When the quantity of the ink now remaining within the ink cartridge 4 is less than the reference quantity of the ink, the comparative signal (COMP) is output from comparator 12 to switching member Q1 of voltage generator 20, then the switching member (Q1) is turned on and the second resistor (R2) gets cut (or closed) and so the impedance value of the voltage generator 20 is R1+R2 X R3/(R2+R3). Accordingly, the motor driving control voltage (VA) has the second voltage as R2+R3/{(R2+R3) X R1+R2XR3} X Vcc.

That is, the second voltage as the motor driving control voltage (VA) in the activating case of the comparative signal (COMP) being received by voltage generator 20 has a comparatively lower voltage than the first voltage as the motor driving control voltage (VA) in the inactivating case of the comparative signal (COMP) not being received by the voltage generator 20.

Upon the motor controller 30 receiving at least one of the first and second phase signals (P1, P2) for the driving current of the carrier motor 5 and the motor driving control voltage (VA), the motor driving control voltage (VA) has the first voltage when, namely, the quantity of the ink remaining within the ink cartridge exceeds the reference quantity of the ink. Then, because the driving load of the carrier motor 5 in such case is relatively large, the driving current of the carrier motor 5 is also relatively large. Therefore, the motor controller 30 outputs a number of phase control signals (PA, PAB, PB, PBB) each having associated therewith a large driving current when the motor driving control voltage (VA) has the first voltage for driving the carrier motor 5. The second phase control signal (PAB) of the number of phase control signals is a signal having made a reverse turn of the first phase control signal (PA), and the fourth phase signal (PBB) is a signal having made a reverse turn of the third phase control signal (PB).

The motor driving control voltage (VA) has the second voltage which is smaller than the first voltage when, namely, the quantity of the ink remaining within the ink cartridge 4 is less than the reference quantity of the ink, the driving load of the carrier motor 5 being relatively small. Therefore, even though the driving current of the carrier motor 5 is smaller than the driving current of the carrier motor 5 in case of the motor driving control voltage (VA) having the first voltage, the carrier motor 5 can sufficiently drive for reciprocating movement the ink cartridge 4 and printer head 3 on carrier 2.

Also, the motor controller 30, when the motor driving control voltage (VA) has the second voltage, outputs a number of phase control signals (PA, PAB, PB, PBB) having associated therewith a comparatively smaller driving current than in the case that the motor driving voltage (VA) has the first voltage.

Therefore, the motor driving device of the present invention changes or adjusts the driving current of the carrier motor according to the quantity of the ink stored within the ink cartridge. As a result, unnecessary noise can be prevented and electric power consumption can be saved.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A motor driving device for an inkjet printer, comprising:

an inkjet printer head for reciprocating movement on a carrier of said inkjet printer;

an ink storing vessel for reciprocating movement concurrently with said inkjet printer head and for connection with said inkjet printer head;

a detecting means for sensing an amount of remaining ink in said ink storing vessel;

a driving means for driving said reciprocating movement of said inkjet printer head and said ink storing vessel; and a power controller for changing a voltage supplied to said driving means to provide a variable voltage for driving said reciprocating movement of said inkjet printer head and said ink storing vessel according to a sensing result of sensing said amount of remaining ink in said ink storing vessel by said detecting means.

2. A method for driving a carrier motor for a carrier of an ink cartridge for an inkjet printer, comprising the steps of:

detecting an ink consumption quantity for an ink quantity stored within said ink cartridge;

outputting a comparative signal when said ink quantity stored within the ink cartridge is less than a reference ink quantity;

outputting a motor driving control voltage varying in magnitude according to whether said comparative signal is output; and outputting at least one of a plurality of phase control signals, each phase control signal corresponding to a different driving current for driving said carrier motor according to said motor driving control voltage.

3. The method as claimed in claim 2, further comprising providing at least one of a first phase signal and a second phase signal for said driving current in addition to said at least one of said plurality of phase control signals to drive said carrier motor according to said motor driving control voltage.

4. The method as claimed in claim 3, further comprised of said motor driving control voltage being at a first voltage when said comparative signal is not output and said motor driving control voltage being at a second voltage smaller than said first voltage when said comparative signal is output.

5. The method as claimed in claim 2 further comprised of said motor driving control voltage being at a first voltage when said comparative signal is not output and said motor driving control voltage being at a second voltage smaller than said first voltage when said comparative signal is output.

6. A motor driving device, comprising:

a carriage for reciprocating movement;

a cartridge mounted on said carriage;

a motor for driving said carriage for reciprocating movement;

a detecting means for sensing an amount of remaining ink stored in said cartridge; and a controller for controlling a voltage supplied to said motor to provide a variable voltage for driving said carriage for reciprocating movement according to the amount of remaining ink in said cartridge sensed by said detecting means.

7. The motor driving device as claimed in claim 6, further comprised of:

said detecting means detects an ink consumption quantity and outputs a comparative signal when the remaining ink stored in the cartridge is less than a reference ink quantity, the detecting means for counting a quantity of an ink drop signal for producing at least one ink drop by at least one nozzle of an inkjet printer to provide a count signal indicating a present ink quantity stored within the cartridge, and for comparing said count signal with a reference signal indicating the reference ink quantity; and said controller comprising:

a voltage generator for outputting a motor driving control voltage, said motor driving control voltage being a variable voltage according to whether said comparative signal is output from said detecting means for reception by said voltage generator; and a motor controller for outputting a plurality of phase control signals, each phase control signal corresponding to a different driving current for driving said motor according to said motor driving control voltage, said motor controller for receiving said motor driving control voltage.

8. The motor driving device as claimed in claim 7, further comprised of said detecting means comprising:

a counting means for outputting said count signal to indicate said present ink quantity stored in said cartridge through counting each said ink drop signal by receiving each ink drop signal producing a corresponding at least one ink drop formed in at least one of a plurality of nozzles of said inkjet printer; and comparative means for outputting said comparative signal when said count signal is smaller than said reference signal by receiving and comparing said count signal and said reference signal indicating the reference ink quantity.

9. The motor driving device as claimed in claim 7, further comprised of said voltage generator for outputting said motor driving control voltage at a first voltage when said comparative signal is not output by said detecting means, and said voltage generator for outputting said motor driving control voltage at a second voltage smaller than said first voltage when said comparative signal is output by said detecting means.

10. The motor driving device as claimed in claim 7, further comprised of said voltage generator comprising:

a first resistance device, one terminal of said first resistance device for connection to a first supply voltage and another terminal of said first resistance device for outputting said motor driving control voltage;

a second resistance device, one terminal of said second resistance device for connection to said motor driving control voltage;

a third resistance device, one terminal of said third resistance device for connection to said motor driving control voltage; and a switching device, said switching device for connection to another terminal of said second resistance device and to another terminal of said third resistance device, said another terminal of said third resistance device being selectively closed and opened to a second supply voltage by said switching device becoming selectively turned on and off according to whether said comparative signal is received by said switching device from said detecting means.

11. The motor driving device as claimed in claim 10, further comprised of said second supply voltage being a local reference voltage and said first supply voltage being a larger voltage in magnitude than said second supply voltage.

12. The motor driving device as claimed in claim 10, further comprised of said switching device comprising a transistor including an emitter, a base and a collector, with said emitter for connection to said second supply voltage and said base being operatively responsive to said comparative signal from said detecting means and with said collector for connection to said another terminal of said second resistance device.

13. The motor driving device as claimed in claim 10, further comprised of said voltage generator for outputting said motor driving control voltage at a first voltage when said comparative signal is not output by said detecting means, and said voltage generator for outputting said motor driving control voltage at a second voltage smaller than said first voltage when said comparative signal is output by said detecting means.

14. The motor driving device as claimed in claim 13, further comprised of said second supply voltage being a local reference voltage and said first supply voltage being a larger voltage in magnitude than said second supply voltage.

15. The motor driving device as claimed in claim 7, further comprised of said detecting means comprising:

a counting means for outputting said count signal to indicate said present ink quantity stored in said cartridge through counting each said ink drop signal by receiving each ink drop signal producing a corresponding at least one ink drop formed in at least one of a plurality of nozzles of said inkjet printer; and a comparative means for outputting said comparative signal when said count signal is smaller than said reference signal by receiving and comparing said count signal and said reference signal indicating the reference ink quantity; and said voltage generator comprising:

a first resistance device, one terminal of said first resistance device for connection to a first supply voltage and another terminal of said first resistance device for outputting said motor driving control voltage;

a second resistance device, one terminal of said second resistance device for connection to said motor driving control voltage;

a third resistance device, one terminal of said third resistance device for connection to said motor driving control voltage; and a switching device, said switching device for connection to another terminal of said second resistance device and to another terminal of said third resistance device, said another terminal of said third resistance device being selectively closed and opened to a second supply voltage by said switching device becoming selectively turned on and off according to whether said comparative signal is received by said switching device from said detecting means.

16. The motor driving device as claimed in claimed 15, further comprised of said switching device comprising a transistor including an emitter, a base and a collector, with said emitter being for connection to said second supply voltage, and with said base being operatively responsive to said comparative signal from said detecting means and with said collector being for connection to said another terminal of said second resistance device.

17. The motor driving device as claimed in claim 15, further comprised of said motor controller selectively outputting said plurality of phase control signals for said driving current for said motor according to whether said motor driving control voltage is at a first voltage for providing a larger driving current for said motor than when said motor driving control voltage is at a second voltage smaller than said first voltage, said second voltage for providing a smaller driving current than a driving current corresponding to said first voltage.

18. The motor driving device as claimed in claim 7, further comprised of said motor controller selectively outputting said plurality of phase control signals for said driving current for said motor according to whether said motor driving control voltage is at a first voltage for providing a larger driving current for said motor than when said motor driving control voltage is at a second voltage smaller than said first voltage, said second voltage for providing a smaller driving current than a driving current corresponding to said first voltage.

* * * * *